United States Patent [19]

Dubach

[11] Patent Number: 4,869,399

[45] Date of Patent: Sep. 26, 1989

[54] PLASTIC CAP ASSEMBLY FOR CONTAINERS IN WHICH THE NECK IS SEALED BY A FOIL OR MEMBRANE

[75] Inventor: Werner F. Dubach, Maur, Switzerland

[73] Assignee: Alfatechnic AG, Switzerland

[21] Appl. No.: 206,588

[22] Filed: Jun. 14, 1988

[30] Foreign Application Priority Data

Feb. 16, 1987 [CH] Switzerland ..... 2284/87

[51] Int. Cl.[4] ..... B67B 7/24

[52] U.S. Cl. ..... 222/83; 222/89; 222/153; 222/182

[58] Field of Search ..... 222/81, 83, 89, 91, 222/543, 182, 153; 604/411, 414

[56] References Cited

U.S. PATENT DOCUMENTS

| | | | |
|---|---|---|---|
| 2,721,552 | 10/1955 | Nosik | 222/81 |
| 3,406,872 | 10/1968 | Fiquet et al. | 222/83 |
| 4,377,248 | 3/1983 | Stull | 222/543 |
| 4,456,150 | 6/1984 | Yang | 222/153 |
| 4,570,826 | 2/1986 | Fattori | 222/83 |
| 4,696,408 | 9/1987 | Dubach . | |

*Primary Examiner*—H. Grant Skaggs

*Attorney, Agent, or Firm*—Thomas W. Speckman; Douglas H. Pauley

[57] ABSTRACT

A plastic cap assembly with a base cap and a cap that is formed in one piece and may be installed on the neck of the container that is sealed with a foil or a membrane. A projection in the flat wall of the base cap has on its underside a penetrator with which the foil can be penetrated. The contents of the container can then flow through the hole in the foil from the penetrator to the pour opening. The cap assembly is simple to operate and to produce; it supports the foil and in addition can be safety sealed. It is particularly well-suited for containers used for readily oxidizable foodstuffs such as ketchup, for example.

10 Claims, 3 Drawing Sheets

PLASTIC CAP ASSEMBLY FOR CONTAINERS IN WHICH THE NECK IS SEALED BY A FOIL OR MEMBRANE

BACKGROUND OF THE INVENTION

Field of the Invention

The present invention relates to a plastic cap assembly for a container with a neck that is sealed by foil or a membrane, this having a base cap with a pour spout and a penetrator, as well as a cap or a cover with a seal that covers the pour spout in the base cap.

Cap assemblies of this kind are already known from U.S. Pat. Nos. 4,456,150 and 4,696,408. These cap assemblies have safety devices that keep the base cap or the cap or cover, respectively, in an upper safety position relative to the upper edge of the container neck and which can only be moved into a lower position after removal of the safety device, in which connection, during this relative movement towards the container neck, parts of this cut or penetrate the sealing membrane or foil with appropriate means that are provided for this purpose.

Even though cap assemblies of this kind have proved themselves in use from a purely technical standpoint, one unanticipated problem has arisen. Although removal of the safety seal can be managed correctly by the majority of end users, experience has shown that this does not apply to the second step involved in opening the cap assembly. The cap assembly must now be moved into a lower position that orients it towards the container neck in order to penetrate the foil or membrane. For the end user, this corresponds to a closing-type movement. However, since the user wants the container opened, he does not complete the functionally correct but seemingly illogical movement, but rather attempts to open the cap completely by a corresponding turning movement or by pulling on it. If he succeeds in so doing, he then finds the still intact foil or membrane, whereupon he penetrates this and then screws the cap assembly back in place. This in no way corresponds to the correct procedure. Some cap assemblies are fitted with safety seals so that the cap cannot be pulled off or screwed off. Unfortunately, it has been found that this has only led to the fact that end users who have not understood the proper procedure for opening the cap assembly have used so much force that the cap assembly has been destroyed.

A second, purely technical, problem with such cap assemblies with an upper sealed position and a lower use position lies in the fact that the foil or membrane that seals the neck of the container is not supported by the cap assembly when in the sealed position. This renders the guarantee of such sealing questionable. Under some conditions, the pressure beneath the membrane or foil can fluctuate. If the cap assembly is not on the foil or membrane that is applied to the neck of the container, the foil or membrane can only be welded onto the container neck through the cap assembly either inadequately or not at all by induction welding. Leakage is then unavoidable in the event that there is even a slight increase in pressure beneath the membrane.

Examples of the most frequent causes of such pressure increases are improper transportation (upside down), the generation of gases during fermentation processes, temperature increases, or shaking.

SUMMARY OF THE INVENTION

Thus, it is the task of the present invention to create a cap assembly of the type described in the introduction hereto, this cap assembly avoiding the problems described above and which is more reliable in operation. This task has been solved by a cap assembly comprising a base cap with a pour opening and a penetrator, and a cap with a seal that covers the pour opening in the base cap which has a knob-like projection protruding above a flat wall of the base cap that covers the membrane seal, the wall thickness in at least the transitional area between the flat wall to the projection being so reduced that the projection can be pressed down to almost the level of the flat wall without deforming the flat wall thereby, the penetrator being attached to the underside of the projection.

If examination of the cap assembly is to reveal whether the foil has been penetrated, in that the raised portion remains in the depressed position, this can be achieved in that the raised portion is in the form of a truncated cone whose inclined casing walls are of a lesser thickness than the flat wall, whereas the wall that forms the top surface is of approximately the same thickness as the flat wall.

Further embodiments of the present invention comprise a plastic cap assembly as defined above having one or more of the features wherein the projection is in the form of a truncated cone having an inclined casing wall which is of an overall lesser thickness than the flat wall, and a top wall approximately the thickness of the flat wall; the projection is ball-shaped and has a wall thickness reduced only in a transitional area between the flat wall to the projection; the underside of the flat wall has an annular bead that faces the wall of the neck of the container; the penetrator is in the form of a cylinder that is cut at an angle to its axis of rotation; the cap assembly is in one piece and the cap is connected to the base cap through a film hinge; the pour opening is arranged eccentrically within the area that is opposite a film hinge and the projection is located between the pour opening and the film hinge; the cap assembly is secured to the container by means of a tearable safety seal band; the underside of the flat wall in the area between the projection and the pour opening has at least one rib that extends in the direction of the connection, the height of which corresponds to the height of the intervening space between the underside of the flat wall and the membrane that seals the neck of the container and is to be penetrated; the projection is in the form of a ramp that is hinged at one end, the casing wall that extends from the ramp to the flat wall being of a lesser thickness than the flat wall; the ramp close to said pour opening is hinged to the base cap; and the penetrator is formed by at least two ribs that extend in the longitudinal direction of the ramp; and at one end, the ribs have claws to perforate the membrane that seals the neck of the container.

BRIEF DESCRIPTION OF THE DRAWING

Two specific embodiments of the present invention will be described below on the basis of the drawings wherein.

DESCRIPTION OF PREFERRED EMBODIMENTS

Figure 1:
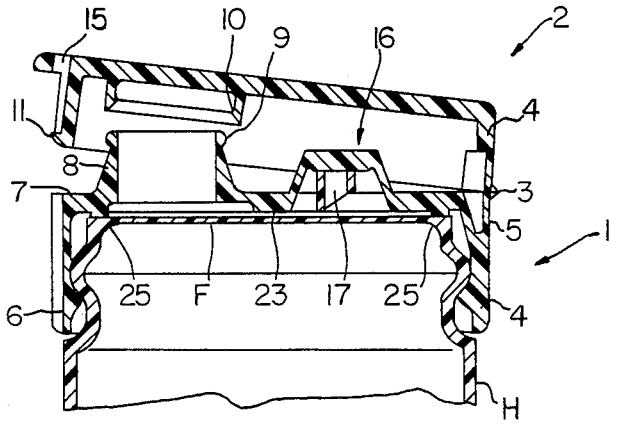
FIG. 1: A half-open cap assembly in cross section prior to perforation of the foil.
Figure 2:
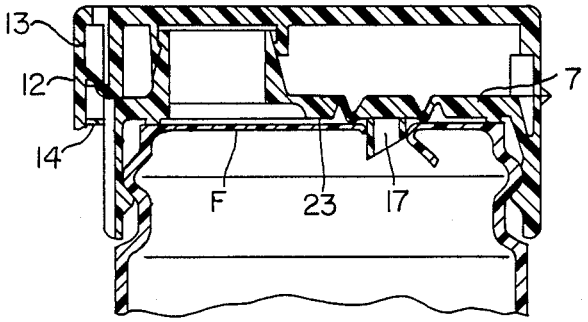
FIG. 2: The cap assembly of FIG. 1 in cross section after penetration of the foil.

FIGS. 1–4 show one embodiment of the present invention; in this, the cap assembly is a hinged, snap-type cap. It is possible, however, to realize this as a screw cap system without prejudice to the concept of the invention. Naturally, in this case, too, there must also be a base cap 1 installed on the neck H of the container. The base cap can also be of a screw type and be provided with means to prevent it being screwed off.

In the solution shown, the base cap 1 is connected to the cap 2 through two strip hinges 3 so as to form one piece. The cap is arranged with a strap retainer 5 that lines up with the vertical casing wall 4. The encircling vertical casing wall 4 of the base cap 1 and the cap 2 is grooved on the side opposite the hinge 3 in order to make it easier to grip. On the inner side of the casing wall of the base cap 1 there is an annular bead 6 for attachment to the neck H of the container. The top surface of the base cap 1 is formed by a flat wall 7. A spout-like pouring opening 8 rises above this, and this has a bead 9 at the top. When the cap assembly is closed, the bead 9 is enclosed by the seal 10 on the underside of the cap. The seal 10 is formed by an annular wall that is oriented precisely towards the pouring opening 8. The positive, shape locking fit between the annual bead 9 and the annular wall of the seal 10 holds the base cap and the cap in the closed position. This is not done by the hooks 11 that project radially outwards on the front of the cap. These hooks 11 serve only to engage with counter-hooks 12 on the safety sealing band 13 that is connected through bridge pieces 14 to the base cap 1. For reasons of tooling, there is an opening 15 in the cap in the area above the hook 11.

Figure 4:
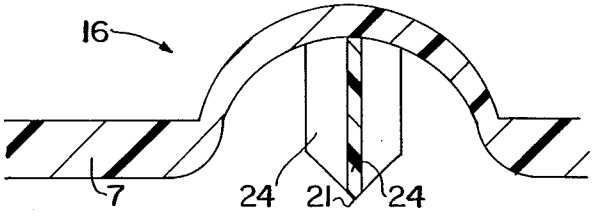
FIG. 4: A simplified cross section of another embodiment for foil penetration.
Figure 3:
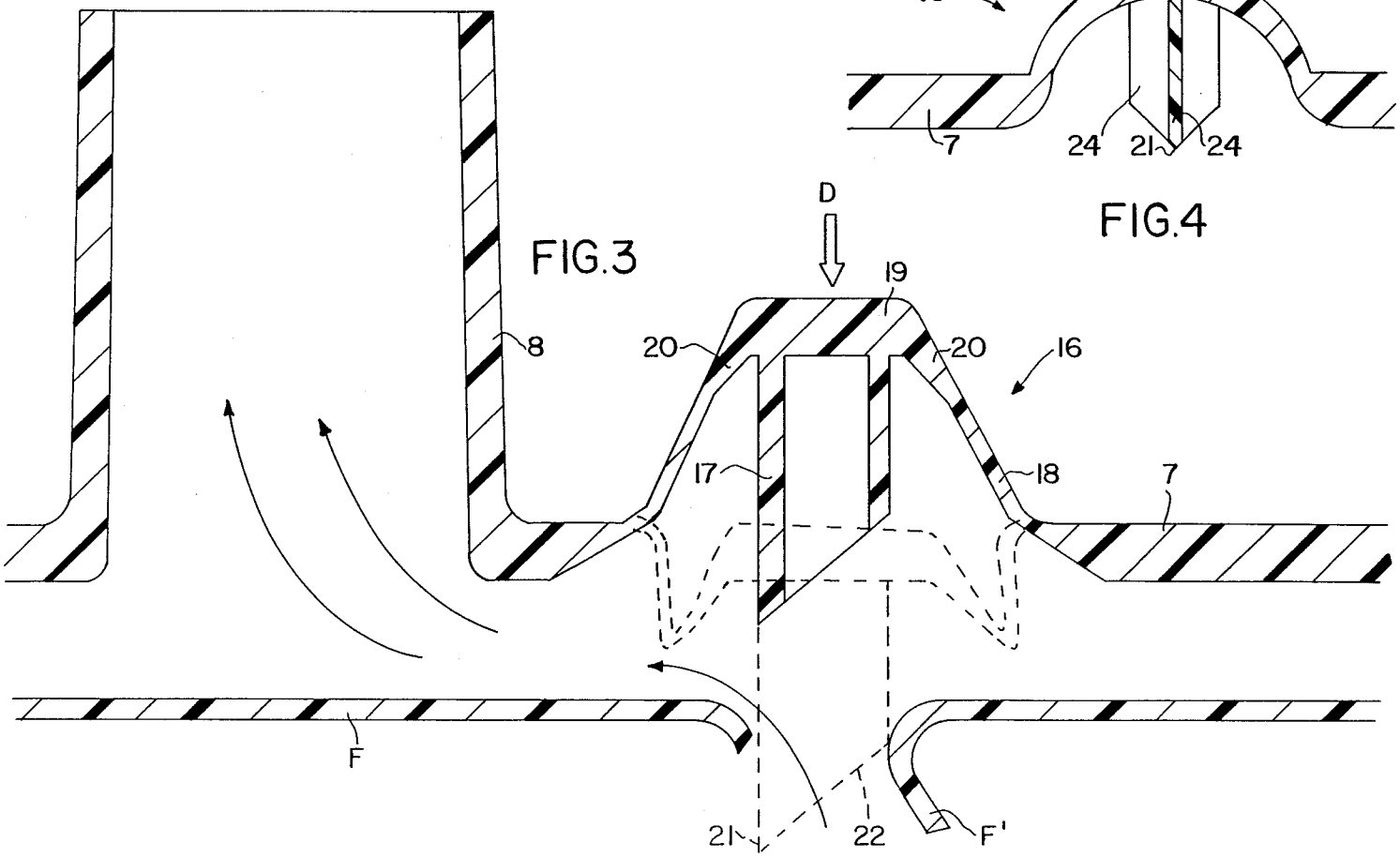
FIG. 3: An enlarged cross section through a part area of foil penetration as in FIG. 1 and FIG. 2.

In order to provide for penetration of the foil or membrane F that is welded on the container neck H, a knob-like raised portion 16 is formed into the flat wall 7 of the base cap. On the underside of this knob-like projection 16 there is a device 17 to penetrate the foil F. Two embodiments of this projection 16 are shown in FIGS. 3 and 4 at larger scale and in cross section. These two embodiments vary not only in the external shape, but also in the manner in which they work. The embodiment shown in FIG. 3 has two stable end positions, whereas the embodiment shown in FIG. 4 has only one stable end position.

FIG. 3 shows in solid lines the end position prior to penetration of the foil or membrane F and in dashed lines the end position after penetration. Here, the knob-like projection is in the form of a truncated cone. The thickness of the total inclined wall 18 is considerably thinner than the thickness of the flat wall 7 of the top surface of the base cap 1, whereas the upper wall 19 of the truncated cone once again approximates very closely the thickness of the flat wall 7.

The force D exerted by the user's finger presses the projection downwards, whereupon the inclined wall 8 folds together. A slightly thickened section 20 of the inclined wall 8 prevents the projection being pressed beneath the level of the flat wall 7. The penetrator 17 can be of various shapes. The best results have been obtained with the embodiment shown. Here, a cylindrical wall is cut at an angle to the axis of rotation, with the tip 21 being located closer to the pour opening 8. The foil F is cut by the tip 21 and tears away from the pour opening. The torn portion F' of the foil rolls along the inclined cut surface 22 and form the foil tab F' which is held, rolled up, by the short side of the cylindrical wall.

Now, the contents of the container flow between the foil F and the flat wall 7 of the base cap 1 to the pour opening 8. Tests have shown that the container contents that get between the foil F and the wall 7 generate pressure that leads to the foil tearing even more. In order to enhance both safety and the effect that has been described, it can be useful to provide one or a plurality of ribs 23 in the area between the projection 16 and the pour opening 8, these ribs being arranged in the direction of connection between these two elements.

The embodiment that is shown in FIG. 4 has a knob-like projection 16 that is in the form of a cupola or ball. Here, the whole wall of the projection is thinner than the flat wall 7. The penetrator is here in the form of two walls 24 that intersect at right-angles, and once again these converge to form a point. Thus, the foil F that seals the container neck is cut in cruciform fashion. Once the foil has been penetrated the knob-like projection returns automatically to its starting position. However, a solution such as this is more suitable for larger caps because the knob-like projection has to be relatively large in order to have sufficient travel to cut through the foil. However, the solution shown in FIG. 3 is suitable for smaller containers in which sufficient space can be created by arranging the pour opening eccentrically within the base cap.

Such a cap assembly is easy for the user to operate, and the instruction "PRESS" can be displayed on the projection, if desired.

The foil is located very close to the underside of the flat wall 7 that covers it, and can rest against this surface should it be caused to bulge as a result of internal pressure.

An annular bead 25 is also arranged on the underside of the flat wall 7 and this faces towards the neck H of the container that is located below. This serves to secure the foil F on the container neck and additionally improves the induction welding of the foil onto the container neck when the cap assembly is in position.

The solution shown is also cost-effective in comparison to the solutions in the prior art described above. The solution shown in FIGS. 1 to 3 also entails the advantage that the user can immediately see that the contents have been tampered with, that is, whether the seal is still intact.

Such cap assemblies are particularly well suited for containers that are filled with liquid, readily oxidizable contents. Since the user cannot see the foil, it is possible to use an economical quality.

Figure 5:
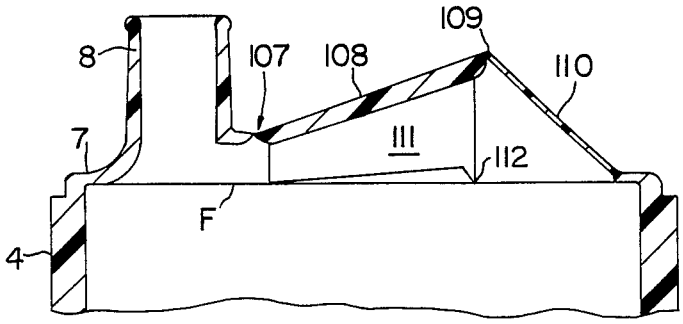
FIG. 5: A sectional view of another embodiment of a cap assembly with a ramp-like projection, in the starting position.
Figure 6:
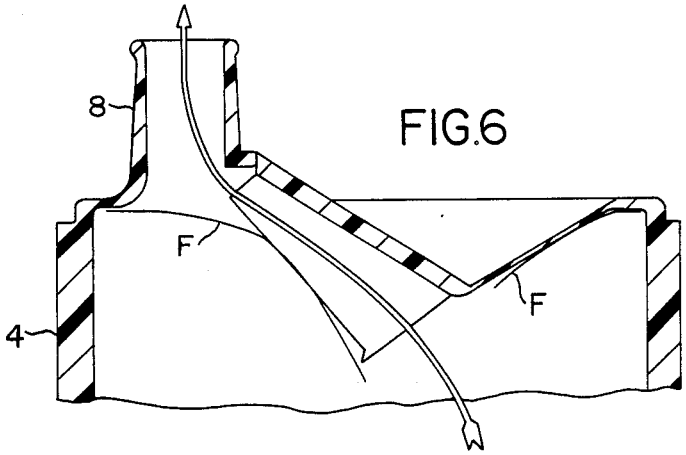
FIG. 6: The ramp as in FIG. 5, in the use position and with the foil penetrated.

A second embodiment of the cap assembly according to the present invention is shown in FIGS. 5 and 6. This embodiment is particularly well suited for use with viscous or paste-like fluids. The figures shown a diametrical cut through the base part of the cap assembly. The cover, which remains unchanged compared to the embodiment described heretofore, has been omitted from the drawing.

Figure 7:
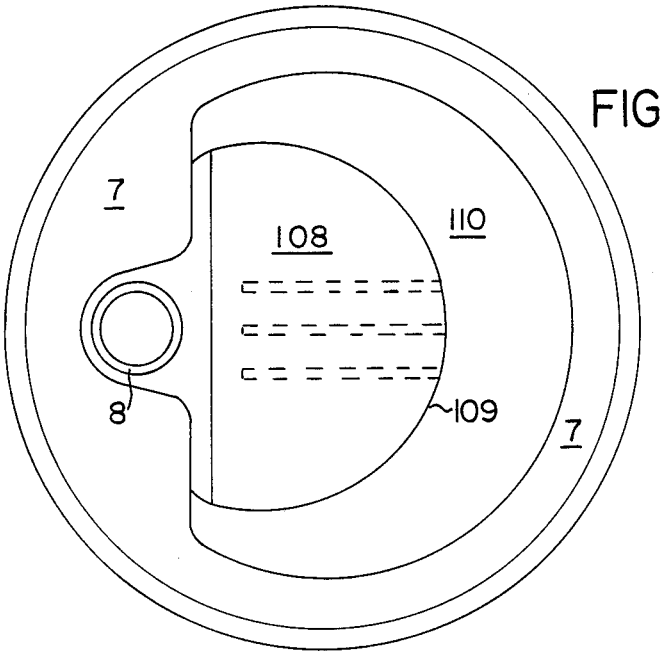
FIG. 7: A view of the underside of the cap assembly shown in FIGS. 5 and 6, showing the ramp-like projection.

The base cap has once again the vertical casing wall 4 described heretofore and this is closed off by a flat covering wall 7. The eccentrically disposed spout-like pour opening 8 rises from this. The projection 108 in the flat wall 7, is however, in the form of a one-sided pivotable ramp 108. The axis of rotation is formed by a film hinge 107, which is close to the pour opening 8. In the starting position, a pressure surface 108 extends from the film hinge 107 and slopes upwards to an edge 109. The wall thickness of the pressure surface 108 is relatively thick and for this reason is resistant to bending. The enclosing wall 110, which extends from the edge 109 down to the flat wall 7 is thin, and thus flexible. The shape of the ramps is semicircular, as can be seen very clearly from FIG. 7. This shape is governed not only by aesthetic considerations; in the event of a rotating motion, it leads to an even distribution of the deformation of the flexible wall 110.

At least two—in the embodiment shown, three—parallel ribs 111 are molded into the underside of the pressure surface 108. These ribs 111 provide additional stiffening of the pressure surface 108. They are perpendicular to the film hinge 107 and extend to the edge 109. In the starting position that is shown in FIG. 5, the ribs 111 extend down almost as far as the underside the flat wall 7. The foil or membrane of the sealed neck of the bottle thus does not touch the ribs 111 in the starting position. At the end, approximately vertically under the edge 109 there are claws 112. These claws penetrate the foil located beneath them as soon as pressure is applied to the surface 108. On further rotational movement of the ramp 108 at least the two outermost ribs 111 cut the foil or membrane and push it downwards. The pressure surface 108 is pushed downwards as far as it will go until it is in the lower, stable end position, the use position, in which it remains, as is shown in FIG. 6. The now destroyed foil F lies on one side against the flexible wall 110, that is lower than the flat wall 107, and against the ribs 111, which now extend into the neck of the bottle. The ribs now keep open a channel between the pressure surface 108, which is now inclined downwards, and the foil F, and the fluid can now flow from the container, through this channel, to the pour spout 8.

I claim:

1. A plastic cap assembly for a container having a membrane sealed neck, said assembly comprising a base cap with pour opening and a penetrator, and a cap connected to said base cap with a film hinge, said cap having a seal that covers said pour opening in said base cap, said a base cap having a knob-like projection (16) separated from said pour opening and protruding above a flat wall (7) of said base cap (1) that covers said membrane (F), a wall thickness in at least a transitional area between said flat wall (7) to said projection (16) being so reduced that said projection (16) can be pressed down to almost a level of said flat wall (7) without thereby deforming said flat wall, said penetrator (17) attached to an underside of said projection; in a ruptured condition of said membrane (F) said four opening in communication with said ruptured membrane (F), and said projection being safely concealed in a closed position of said cap by said cap having a detachable safety sealing band (13).

2. A plastic cap assembly as defined in claim 1, wherein said projection (16) is in a form of a truncated cone having an inclined casing wall (18) which has an overall lesser thickness than said flat wall (7), and has a top wall (19) approximately as thick as said flat wall (7).

3. A plastic cap assembly as defined in claim 1, wherein said projection (16) is ball-shaped and has said wall thickness reduced only in said transitional area.

4. A plastic cap assembly as defined in claim 1, wherein on an underside of said flat wall (7) there is an annular bead (25) that faces a wall of a neck (H) of said container.

5. A plastic cap assembly as defined in claim 1, wherein said penetrator (17) is in a form of a cylinder that is cut at an angle to its axis of rotation.

6. A plastic cap assembly as defined in claim 1, wherein said pour opening (8) is eccentrically positioned within an area that is opposite a film hinge (3) and said projection is located between said pour opening and said film hinge.

7. A plastic cap assembly for a container having a membrane sealed neck, said assembly comprising a base cap with a pour opening and a penetrator, and a cap with a seal that covers said pour opening in said base cap, said base cap having a knob-like projection (16) protruding above a flat wall (7) of said base cap (1) that covers said membrane (F), a wall thickness in at least a transitional area between said flat wall (7) to said projection (16) being so reduced that said projection (16) can be pressed down to almost a level of said flat wall (7) without deforming said flat wall thereby, said penetrator (17) attached to an underside of said projection; and on an underside of said flat wall (7) in an area between said projection (16) and said pour opening (8) there is at least one rib (23) that extends in a direction of a connection having a first height of which corresponds to a second height of an intervening space between said underside of said flat wall (7) and said membrane (F) that seals said neck of said container and is to be penetrated.

8. A plastic cap assembly for a container having a membrane sealed neck, said assembly comprising a base cap with a pour opening and a penetrator, and cap with a seal that covers said pour opening in said base cap, said base cap having a knot-like projection (16) protruding above a flat wall (7) of said base cap (1) that covers said membrane (F), a wall thickness in at least a transitional area between said flat wall (7) to said projection (16) being so reduced that said projection (16) can be pressed down to almost a level of said flat wall (7) without deforming said flat wall thereby, said penetrator (17) attached to an underside of said projection; and said projection (16) is in a form of a ramp (108) that is hinged at one end, a casing wall (110) that extends from said ramp to said flat wall having a thickness less than said flat wall (7).

9. A plastic cap assembly as defined in claim 8, wherein close to said pour opening (8) said ramp (108) is hinged to said base cap; and wherein said penetrator is formed by at least two ribs (111) that extend in a longitudinal direction of said ramp (108).

10. A plastic cap assembly as defined in claim 9, wherein at one end said ribs have claws (112) to perforate said membrane (F) that seals said neck of said container.

* * * * *